US010240385B2

(12) United States Patent
Park

(10) Patent No.: US 10,240,385 B2
(45) Date of Patent: Mar. 26, 2019

(54) METHOD AND APPARATUS FOR CONTROLLING AND CONFIRMING WINDOW POSITION

(71) Applicant: Songhwi Park, Mokpo-si (KR)

(72) Inventor: Songhwi Park, Mokpo-si (KR)

( * ) Notice: Subject to any disclaimer, the term of this patent is extended or adjusted under 35 U.S.C. 154(b) by 198 days.

(21) Appl. No.: 15/308,477

(22) PCT Filed: Oct. 26, 2015

(86) PCT No.: PCT/KR2015/011303
§ 371 (c)(1),
(2) Date: Nov. 2, 2016

(87) PCT Pub. No.: WO2017/003035
PCT Pub. Date: Jan. 5, 2017

(65) Prior Publication Data

US 2017/0268281 A1 Sep. 21, 2017

(30) Foreign Application Priority Data

Jun. 29, 2015 (KR) ..... 10-2015-0092554

(51) Int. Cl.

| | |
|---|---|
| ***G08B 13/08*** | (2006.01) |
| ***E05F 15/74*** | (2015.01) |
| ***E05F 15/689*** | (2015.01) |
| ***E05F 15/695*** | (2015.01) |
| ***E05F 15/697*** | (2015.01) |
| ***E05F 15/70*** | (2015.01) |

(52) U.S. Cl.
CPC ..... *E05F 15/74* (2015.01); *E05F 15/689* (2015.01); *E05F 15/695* (2015.01); *E05F 15/697* (2015.01); *E05F 15/70* (2015.01); *E05Y 2400/33* (2013.01); *E05Y 2400/336* (2013.01); *E05Y 2400/85* (2013.01); *E05Y 2400/86* (2013.01); *E05Y 2900/55* (2013.01)

(58) Field of Classification Search
CPC ..... E05F 15/689; E05F 15/695; E05F 15/697; E05F 15/70; E05Y 2900/55; E05Y 2400/33; E05Y 2400/85; E05Y 2400/86
USPC ..... 49/13, 14; 318/466
See application file for complete search history.

(56) References Cited

U.S. PATENT DOCUMENTS 6,564,661 B2 * 5/2003 DeJonge ..... B60K 37/06 74/335
6,657,316 B1 12/2003 Smith et al.
7,745,749 B2 6/2010 Ito
(Continued)

FOREIGN PATENT DOCUMENTS

KR 2000-0006704 U 4/2000
KR 10-0801104 B1 2/2008
KR 10-2008-0045023 A 5/2008

*Primary Examiner* — Chi Q Nguyen
(74) *Attorney, Agent, or Firm* — Sughrue Mion, PLLC

(57) ABSTRACT

An apparatus and a method for controlling and confirming a window are disclosed. An apparatus for controlling and confirming a window position, includes an input dial including a jog dial or a wheel dial and configured to input an input signal in response to a dialing operation by a user, a window configured to be opened or closed by a magnitude of the input signal inputted by the input dial, and a position confirming device configured to inform the user of a current window position in a tactile manner.

22 Claims, 17 Drawing Sheets

(56) References Cited

U.S. PATENT DOCUMENTS

| | | | | |
|---|---|---|---|---|
| 8,264,338 | B2 * | 9/2012 | Leon | B60K 37/06 340/456 |
| 8,960,361 | B2 * | 2/2015 | Helot | B60K 20/02 180/326 |
| 9,334,949 | B2 * | 5/2016 | Fett | F16H 59/08 |
| 2007/0241707 | A1 * | 10/2007 | Greene | B60N 2/0228 318/466 |
| 2010/0141610 | A1 * | 6/2010 | Yoneji | B60H 1/00985 345/184 |
| 2012/0143409 | A1 * | 6/2012 | Curtis | B60W 50/082 701/22 |
| 2013/0187889 | A1 * | 7/2013 | Pandher | G06F 3/044 345/174 |
| 2014/0052346 | A1 * | 2/2014 | Heirtzler | E05F 15/695 701/49 |
| 2018/0091144 | A1 * | 3/2018 | Kwon | H03K 17/975 |

* cited by examiner

METHOD AND APPARATUS FOR CONTROLLING AND CONFIRMING WINDOW POSITION

CROSS REFERENCE TO RELATED APPLICATIONS

This application is a National Stage of International Application No. PCT/KR2015/011303, filed on Oct. 26, 2015, which claims priority from Korean Patent Application No. 10-2015-0092554, filed on Jun. 29, 2015, the contents of all of which are incorporated herein by reference in their entirety.

TECHNICAL FIELD

The present disclosure in some embodiments relates to a method and an apparatus for controlling and confirming a window position.

BACKGROUND

The statements in this section merely provide background information related to the present disclosure and do not necessarily constitute prior art.

Vehicle side windows generally operate in an up-and-down direction by glass regulators, and are divided into a manual type and a power window type.

The window opens and closes with a motor by a switch provided on a door or a console box. When closing up the window glass in the door, a predetermined edge portion of the window glass is brought into tight contact with a sealing strip of rubber attached on an edge portion of the door window. The open/close switch is operated to actuate the window glass with the driving motor which starts and stops as signaled by an ECU.

However, in a typical vehicle window open/close system, one has to keep on pressing a window open/close switch until the window glass reaches a desired position. Further, this requirement to visually confirm when the opening or closing window finally reaches the target position tends to distract the otherwise forward-looking driver on the road from keeping eyes forward, which can direct the driver to a tragic incident.

DISCLOSURE

Technical Problem

Therefore, the present disclosure has been made in an effort to effectively resolving the above aspects, and at least one embodiment of the present invention seeks to provide an apparatus for controlling the window position, which obviates the need for continuously pressing the button or switch until the window glass reaches a desired position by using a jog dial or a wheel dial.

Further, at least another embodiment of the present invention seeks to provide a function of sensately confirming the current window position by using a jog dial or a wheel dial, and provide an apparatus for confirming the window position to liberate the user from the requirement to visually check the controlled window elevation.

SUMMARY

In accordance with some embodiments of the present disclosure, an apparatus for controlling and confirming a window position includes an input dial, a window and a position confirming device. The input dial includes a jog dial or a wheel dial. The input dial is configured to input an input signal in response to a dialing operation by a user. The window is configured to be opened or closed by a magnitude of the input signal inputted by the input dial. The position confirming device is configured to inform the user of a current window position in a tactile manner.

Further, in accordance with some embodiments of the present disclosure, an apparatus for controlling and confirming a window position of a vehicle includes an input dial, a window and a position confirming device. The input dial includes a jog dial or a wheel dial. The input dial is configured to input an input signal in response to a dialing operation by a user. The window is configured to be opened or closed by a magnitude of the input signal inputted by the input dial. The position confirming device is configured to inform the user of a current window position in a tactile manner.

Moreover, in accordance with some embodiments of the present disclosure, a method of controlling and confirming a window position is provided, which includes (A) rotating a jog dial by a user, (B) transmitting a changed displacement value of a dial displacement sensor to a control unit, (C) determining, by the control unit, a difference between a displacement value of the dial displacement sensor and a displacement value of a window displacement sensor, (D) moving a window glass, and (E) stopping movement of the window glass.

Advantageous Effects

According to the present disclosure as described above, a user can operate opening and closing of the window of a vehicle with a single operation of a button or a switch, and hence the button or the switch does not need to be continuously depressed until the window glass reaches the desired position.

Further, according to the present disclosure, the user can confirm the current window position in a tactile manner when the window is opened or closed, and hence the driver can confirm the window position without distracting his or her view while driving the vehicle, which enhances the safety in driving the vehicle.

REFERENCE NUMERALS

Figure 1:
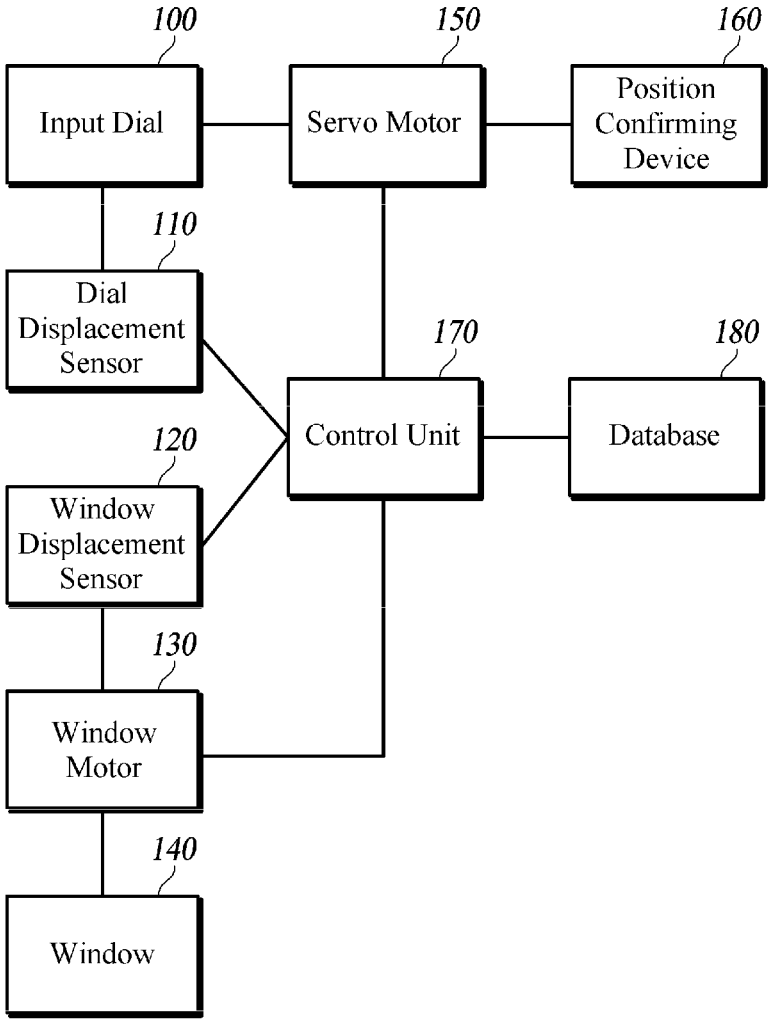
FIG. 1 is a block diagram of an apparatus for controlling and confirming a window position according to at least one embodiment of the present disclosure.

| | |
|---|---|
| 100: Input dial | 110: Dial displacement sensor |
| 120: Window displacement sensor | 160: Position confirming device |
| 170: Control unit | 200: Jog dial |
| 410: Dial | 420: Button top |
| 800: Wheel dial | |

DETAILED DESCRIPTION

Hereinafter, at least one embodiment of the present disclosure will be described in detail with reference to the accompanying drawings. In the following description, like reference numerals designate like elements, although the elements are shown in different drawings. Further, in the following description of the at least one embodiment, a detailed description of known functions and configurations incorporated herein will be omitted for the purpose of clarity and for brevity.

Additionally, various terms such as first, second, A, B, (i), (ii), (a), (b), etc., are used solely for the purpose of differentiating one component from the other but not to imply or suggest the substances, the order or sequence of the components. Throughout this specification, when a part "includes" or "comprises" a component, the part is meant to further include other components, not excluding thereof unless there is a particular description contrary thereto.

Exemplary method and apparatus for controlling and confirming a window position according to embodiments of the present invention are described in detail below with reference to the accompanying drawings.

Figure 2:
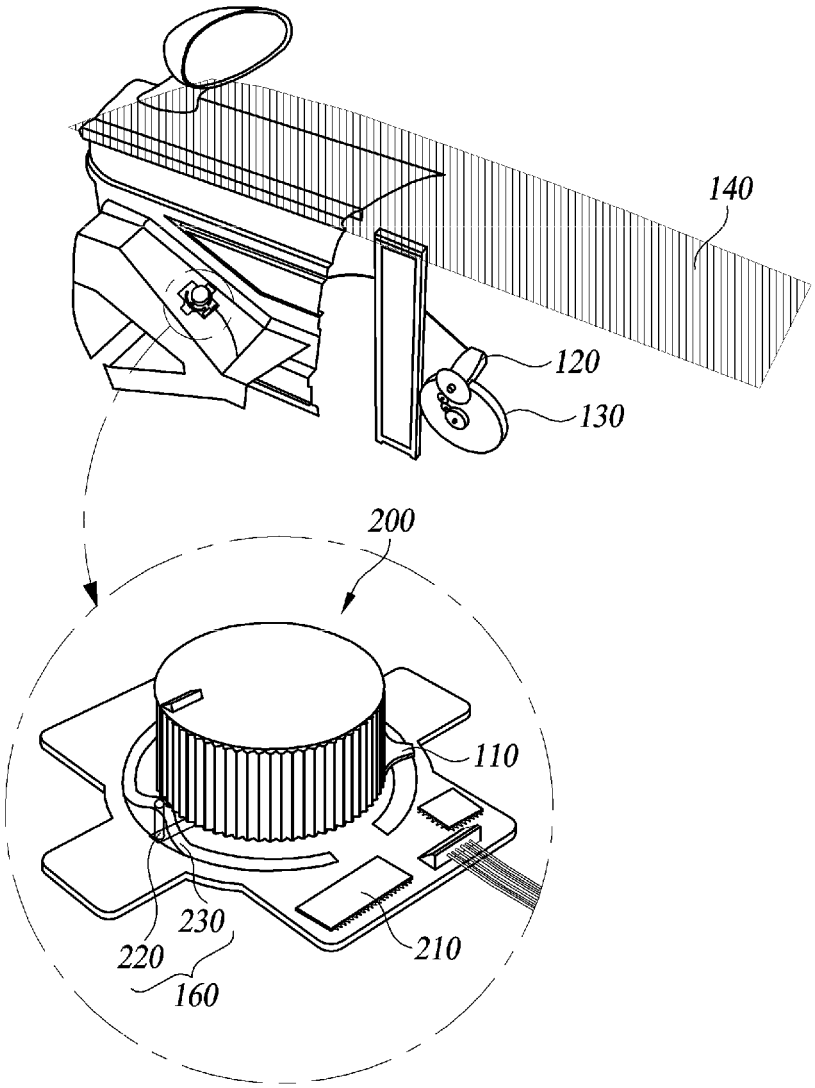
FIG. 2 is a perspective view of the apparatus for controlling and confirming a window position according to at least one embodiment of the present disclosure.
Figure 3:
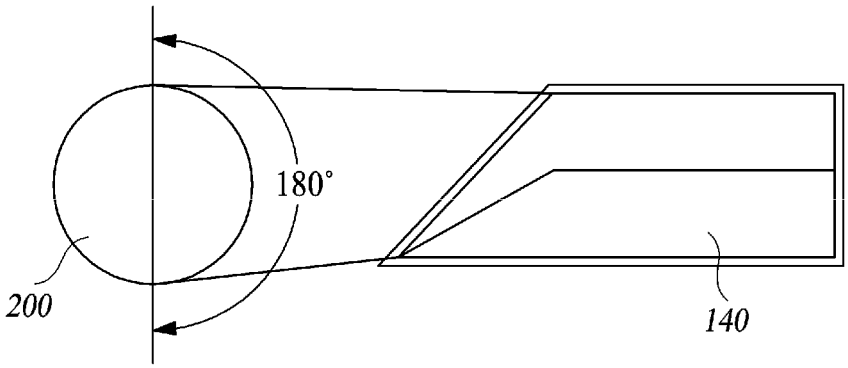
FIG. 3 is a schematic diagram for illustrating a correspondence between a rotation of a jog dial and a movement range of a window glass according to at least one embodiment of the present disclosure.
Figure 7:
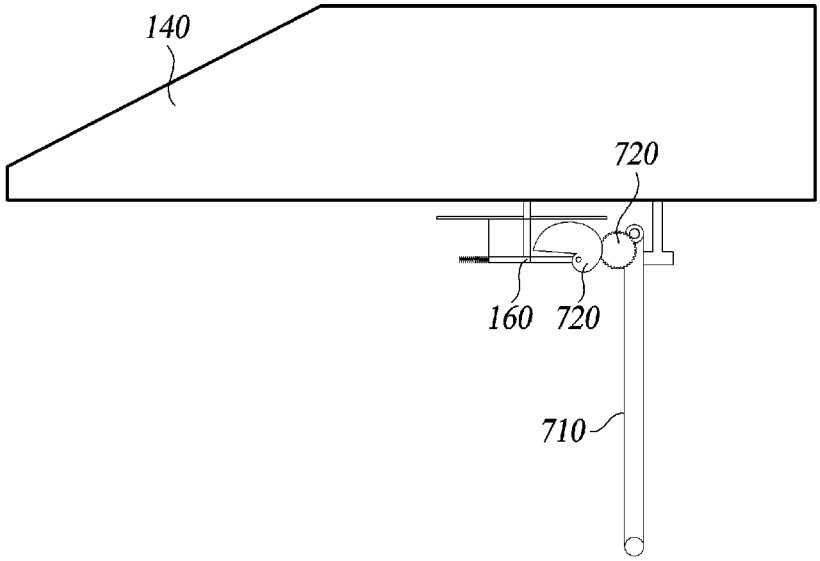
FIG. 7 is a schematic diagram for illustrating a mechanical mechanism for operating the position confirming device according to at least one embodiment of the present disclosure.

FIG. 1 is a block diagram of an apparatus for controlling and confirming a window position according to at least one embodiment of the present disclosure. FIG. 2 is a perspective view of the apparatus for controlling and confirming a window position according to at least one embodiment of the present disclosure. FIG. 3 is a schematic diagram for illustrating a correspondence between rotation of a jog dial and a movement range of a window glass according to at least one embodiment of the present disclosure. FIG. 7 is a schematic diagram for illustrating a mechanical mechanism for operating the position confirming device according to at least one embodiment of the present disclosure.

As shown in FIG. 1, the apparatus for controlling and confirming a window position according to at least one embodiment of the present disclosure includes an input dial 100, a dial displacement sensor 110, a control unit 170, a database 180, a window motor 130, a window displacement sensor 120, a window 140, a servo motor 150 and a position confirming device 160.

The input dial 100 is a type of a jog dial 200 or a type of a scroll wheel of a mouse (hereinafter, a "wheel dial 800"), which is used for a user to give an input to open or close a window. Unlike a conventional type of opening and closing the window based on an input by pressing a button, a dial 410 is rotated to a degree for opening or closing the window to a desired position.

Besides, for the sake of an additional function, the jog dial 200 may be capped with a button top 420 (see FIG. 4) to press or the jog dial 200 may be slidably moved for providing an input which stops the window 140 from being driven as well as controls the opening and closing of the window. Further, the jog dial 200 enables to select a window to be controlled.

The input through the jog dial 200 is effective to move the window to a desired position with a single operation without needing to continue the input operation until the window reaches that position. Details on the configuration of the jog dial 200 are described below.

The window 140 and the window motor 130 are mechanically linked with each other by a chain, a belt or a gear so that the window 140 is opened or closed with an operation of the window motor 130. When a user rotates the input dial 100, the window motor 130 is driven by an instruction from the control unit 170 which will be described later, to open or close the window 140.

Even with a 1:1 ratio set between the movement range of the window and the rotation range of the input dial, when the jog dial is configured to rotate in a range of 180 degrees as shown in FIG. 3, the jog dial 200 can be set so that it is at 180 degrees to bring the window 140 completely closed and at 0 degrees to bring the window 140 fully opened.

However, as this is a mere example, the angular range can be set to 270 degrees, 360 degrees, 480 degrees, or the like.

A displacement sensor is a device that measures a distance between the sensor and a subject by detecting a physical change amount of the subject by various devices and converting the change amount into a distance. Some embodiments includes one displacement sensor located on the input dial (hereinafter, a "dial displacement sensor") and another displacement sensor located on the window motor (hereinafter, a "window displacement sensor"). The displacement sensors may include various types such as a potentiometer, a rotary encoder, a rotary differential transformer, and the like as long as they perform the similar functions.

Therefore, the dial displacement sensor 110 generates changing displacement values in response to a rotation of the jog dial 200, and the window displacement sensor 120 generates changing displacement values or digital data values in response to driving of the window motor 130.

When potentiometers are used for the displacement sensors, a difference in the displacement value is determined based on a difference between variable resistance values. For example, when the dial displacement sensor 110 has a 5-volt default input at an AD (analog-to-digital) 10-bit resolution, the potentiometer output may be 0 volts to 5 volts with an AD conversion result of 0 to 1024. In addition, when the window displacement sensor 120 has the same 5-volt default input at the AD 10-bit resolution, the potentiometer output may be 0 volts to 5 volts with an AD result of 0 to 1024.

Therefore, when the input dial is halfway rotated so that the window moves to its midway position, a potential difference is expressed by 512−512=0 between potentials of the dial displacement sensor 110 and the window displacement sensor 120.

Further, when rotary encoders are used for the dial and window displacement sensors 110, 120, the window position is controlled, for example, based on a difference in incrementing or decrementing encoder outputs between the dial displacement sensor 110 and the window displacement sensor 120 by setting a reference point to 0 and adding +1 when rotating the encoder by angle 1 of a designated degree in the positive direction and adding −1 when rotating the encoder by angle 1 in the negative direction.

The position confirming device 160 is a device with which the user can confirm the degree of opening or closing the window 140 by the sense of touch when the window 140 is moved by an input from the user. The position confirming device 160 includes an external bump or protrusion 220 for the user to recognize by the sense of touch.

Therefore, when the window 140 moves, the protrusion 220 moves by a ratio of an actually traveled distance of the window 140 to the whole movable range thereof. Therefore, the user is informed of the traveled distance or the position to which the window has traveled in a tactile manner by touching the protrusion 220 with a hand.

The position confirming device 160 is driven by the servo motor 150. With an instruction from the control unit 170, the servo motor 150 is driven to move the protrusion 220 of the position confirming device 160.

The position confirming device 160 has its protrusion 220 located adjacent to the input dial 100 to be accessed by the hand of the dial user, in order to facilitate the dial user perceiving the window position immediately.

Therefore, when the input dial 100 is implemented by the jog dial 200, the protrusion 220 of the position confirming device 160 is allowed to move semicircularly in parallel with the outline of the jog dial 200. In the case of the wheel dial 800 (see FIG. 8), the protrusion 220 of the position confirming device 160 is allowed to move in a straight line. For an aesthetic appearance and safety of the user, the protrusion 220 and a moving range thereof can be covered with silicone at 230.

Figure 6:
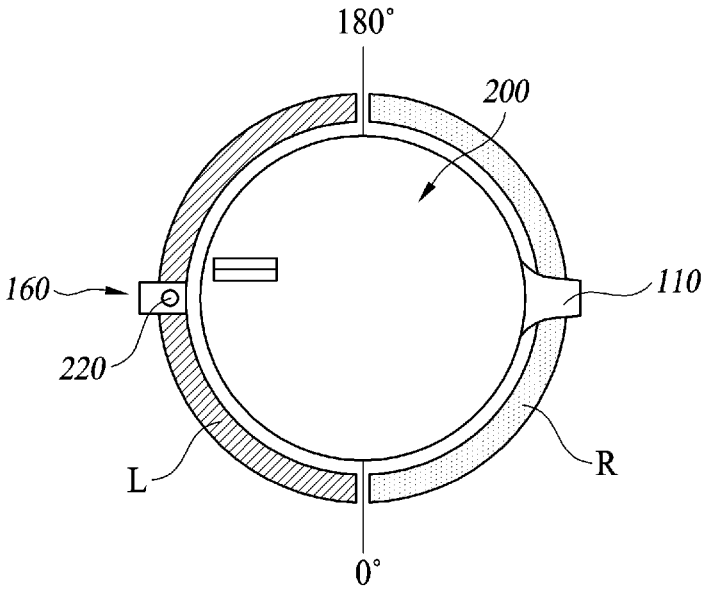
FIG. 6 is a schematic diagram for illustrating movement ranges of a position confirming device and a dial displacement sensor according to at least one embodiment of the present disclosure.

An entire moving range of the protrusion 220 of the position confirming device 160 has a 1:1 correspondence to an entire moving range of the window driven by the window motor 130. Therefore, as shown in FIG. 6, when the protrusion 220 of the position confirming device 160 moves semicircularly in parallel with the jog dial 200, the protrusion 220 moves in a range between 0 degrees and 180 degrees, which is set to the same ratio as the entire moving range of the window.

The servo motor 150, not only operates to move the position confirming device 160, but also serves to rotate the dial 410 of the jog dial 200 in response to the user stopping to drive the window motor by pressing the button top 420 (see FIG. 4) on top of the jog dial 200.

The servo motor 150 can be substituted with a different type of DC motor so long as the DC motor performs the same function to move the position confirming device 160 or to rotate the jog dial 200.

Further, the position confirming device 160 can be mechanically driven by a mechanism as shown in FIG. 7. Specifically, the mechanism includes a cable or belt 710 that moves in the up-and-down direction along with the window a linkage connected to the belt 710 and moving down with the window 140, a connecting gear 720 which is rotated by the descending linkage, and a cam 730 formed to be in meshing engagement with the connecting gear 720 to co-rotate at a rotational ratio of 1:1. Then, the cam 730 in rotation can actuate the position confirming device 160 back and forth, in order to achieve the driving thereof. It should be understood that a moving distance of the window 140 corresponds to the movement of the position confirming device 160.

The control unit 170 is electrically connected to the dial displacement sensor 110 and the window displacement sensor 120, and determines a difference or discrepancy between displacement values of the dial displacement sensor 110 and the window displacement sensor 120 based on potential difference values stored in the database 180. In some embodiments, as shown in FIG. 2, the function of the control unit 170 is performed by a microcomputer (micon) 210.

When there occurs a discrepancy between the displacement values of the dial displacement sensor 110 and the window displacement sensor 120 by an input from the jog dial 200, the control unit 170 drives the window motor 130 to eliminate the displacement discrepancy.

However, the displacement discrepancy is not necessarily zeroed between the dial displacement sensor 110 and the window displacement sensor 120. When the dial displacement sensor 110 and the window displacement sensor 120 have default displacement values with non-zero discrepancies therebetween owing to their respective voltage or resistance ratings different from each other, the database 180 can prestore potential difference values at a discrepancy ratio of the displacement values of the two sensors, and the window motor 130 can be driven based on the stored potential difference values in the database 180.

When the window is moved by driving the window motor 130, the control unit 170 controls to drive the servo motor 150 for moving the protrusion 220 of the position confirming device 160 in proportion to the window movement.

However, when the user presses the button top 420 of the jog dial 200 while the servo motor 150 is being driven, the driving of the window motor 130 is stopped, and the non-zero displacement discrepancy in this case between the dial displacement sensor 110 and the window displacement sensor 120 is zeroed by engaging the control unit 170 in driving the servo motor 150 to rotate the dial 410 of the jog dial 200. In this case as well, the position confirming device 160 moves in proportion to the window movement.

Figure 4:
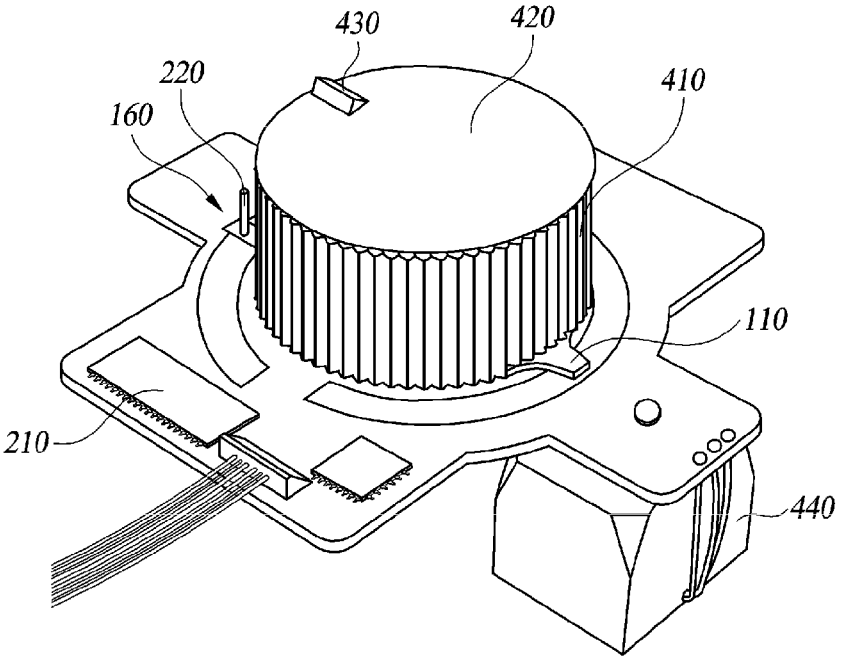
FIG. 4 is a perspective view of the jog dial and its peripherals according to at least one embodiment of the present disclosure.
Figure 5:
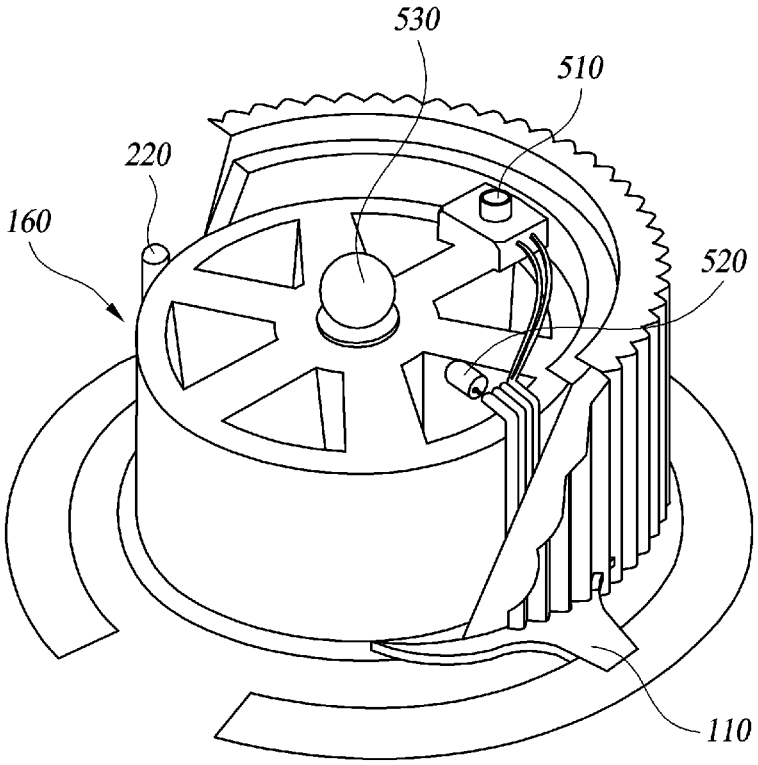
FIG. 5 is a perspective partial sectional view of the jog dial according to at least one embodiment of the present disclosure.

FIG. 4 is a perspective view of the jog dial and its peripherals according to at least one embodiment of the present disclosure. FIG. 5 is a perspective partial sectional view of the jog dial according to at least one embodiment of the present disclosure. FIG. 6 is a schematic diagram for illustrating movement ranges of a position confirming device and a dial displacement sensor according to at least one embodiment of the present disclosure.

As shown in FIG. 4 or 5, the jog dial 200 includes a button top 420, a dial 410, a button switch 510, a joint 530 and a lamp 430.

The dial 410 is a rotating circumferential surface of the input dial 100 in a cylindrical shape. The dial 410 is configured to rotate in a range of 180 degrees in the clockwise direction or in the counterclockwise direction by a user operation. The varying rotational degree determines the corresponding displacement value and in turn the input signal, and the dial 410 makes no automatic return but remains in position once moved by the user's rotation.

On top of the dial 410, the button top 420 is linked internally with the button switch 510 so that a depression by the user of the button top 420 is transferred to the button switch 510 which then transmits a signal to the control unit 170 for causing the control unit 170 to issue an instruction for stopping the window motor 130.

This is effective for the user to stop driving the window by pressing the button top 420 when the user so decides during the driving of the window such as at the time of emergency, or when the window 140 moves farther than desired by the user.

The dial 410 and the button top 420 are configured to be independent from each other, and hence even when the user rotates the dial 410, the button top 420 is not rotated.

The jog dial 200 includes the joint 530 disposed centrally thereof. The joint 530 recognizes a particular direction of pushing the jog dial 200, which can be used to control a specific window, which will be described below.

The jog dial 200 may further include one or more lamps 430. The lamp 430 is provided on the button top 420. The button top 420 includes a transparent planar portion incorporating an LED 520 which can be turned on under certain condition.

The lamp 430 is turned on or flashes when the jog dial 200 is moved or the window 140 is moved, to indicate the status of the jog dial 200 or the operational status of the window 140.

When controlling specific one of windows, a plurality of lamps is provided and the lamps are distinguished from each other by different colors.

With reference to FIG. 6, in terms of a range of the moving area of the position confirming device 160 and the dial displacement sensor 110 around the jog dial 200, the position confirming device 160 moves in 180-degree area (L) on the left side of the jog dial 200. On the other hand, a range of the moving area of the dial displacement sensor covers 180-degree area (R) on the right side of the jog dial 200.

However, the left and right side areas of the position confirming device 160 and the dial displacement sensor 110 are not fixed, and hence the areas can be interchanged, and the areas can each occupy the entire 360-degree range set at one of two different elevations.

Figure 8:
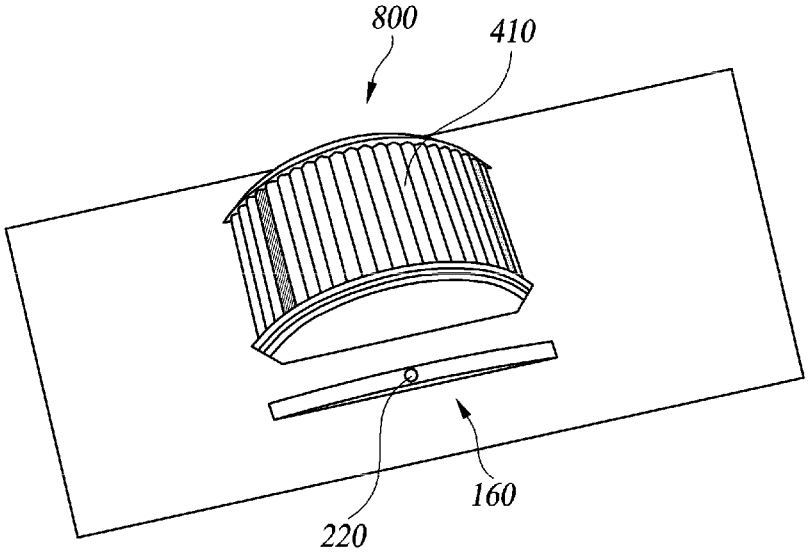
FIG. 8 is a perspective view of a wheel dial according to at least one embodiment of the present disclosure.

FIG. 8 is a perspective view of a wheel dial according to at least one embodiment of the present disclosure.

In the description of the wheel dial 800, the dial 410, the protrusion 220, and the like having similar functions to those in the jog dial 200 are assigned with the same reference numerals, as with other configurations described below.

In some embodiments of the present disclosure, as shown in FIG. 8, the input device is the wheel dial 800. Compared to the jog dial 200, the wheel dial 800 shares a cylindrical shape but is oriented at right angle so that a half of the dial is exposed outwardly.

However, the jog dial 200 and the wheel dial 800 are commonly operated to generate angular displacements with the displacement differences providing a basis for operating the window motor 130. Therefore, in the similar manner to the jog dial 200, the wheel dial 800 rotates in a range between 0 degrees and 180 degrees.

In this case, the position confirming device 160 is provided in a linear shape, unlike the jog dial 200, and the protrusion 220 moves along the straight line to indicate the position of the window. The protrusion 220 moves back and forth as much as the ratio of travelled distance of the window in the up-and-down direction. This enables the user to determine the current window position by the sense of touch with the position confirming device 160.

Figure 9:
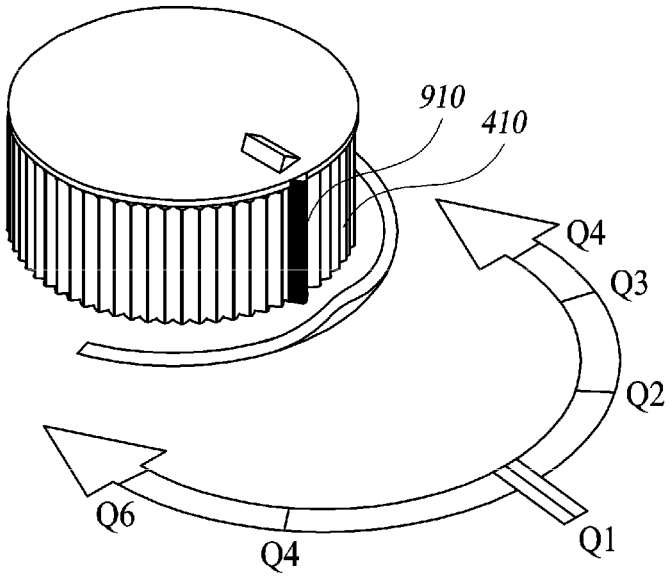
FIG. 9 is a perspective view of a jog dial according to another embodiment of the present disclosure.
Figure 10:
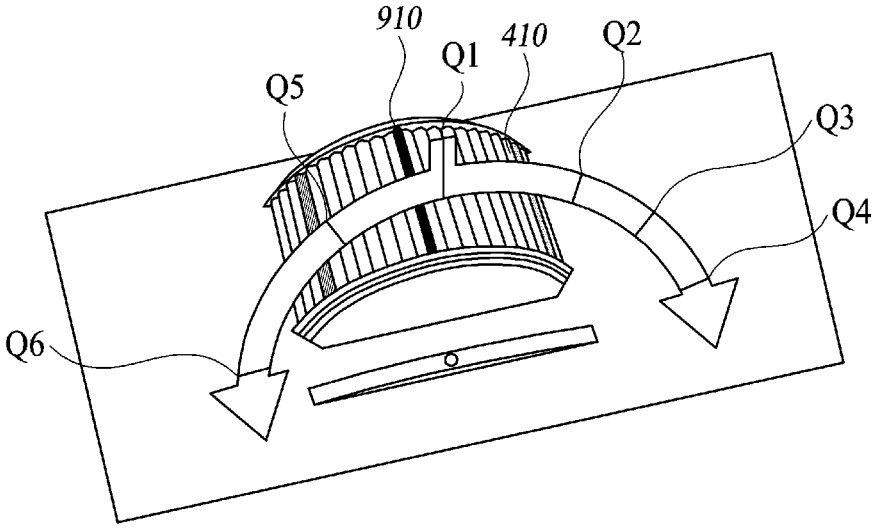
FIG. 10 is a perspective view of a wheel dial according to yet another embodiment of the present disclosure.

FIG. 9 is a perspective view of a jog dial according to another embodiment of the present disclosure. FIG. 10 is a perspective view of a wheel dial according to yet another embodiment of the present disclosure.

The jog dial 200 shown in FIG. 9 further includes a center protrusion 910 on the dial 410 thereof. The center protrusion 910 is located in the middle of the rotational range of the dial 410, and is protruded from the rest of the dial 410, and hence the user can recognize the center protrusion 910 both visually and tactually.

Further, the jog dial 200 according to this embodiment of the present invention returns to its original position after the user rotated the dial by a predetermined angle, and hence the center protrusion always maintains its direction Q1 toward the center.

For example, rotating the center protrusion 910 to position Q2 moves the window from any current position to a 60% closed state, and then the center protrusion 910 returns to the position Q1. In the similar manner, a rotation to Q3 makes the window 80% closed, a rotation to Q5 makes the window 25% closed, a rotation to Q4 makes the window 100% closed, a rotation to Q6 makes the window 100% opened, and after each dial rotation, the center protrusion 910 returns to the position Q1.

Specifically, with a 5-volt default input at the AD 10-bit resolution, the potentiometer output becomes 0 volts to 5 volts, and the AD result becomes 0 to 1024. With the automatic return functionality, the value of the position Q1 is the default value of 512, and hence nonoperational values are set to range from 502 to 522, the operational range becomes 0 to 501 and 523 to 1024, and the value for when the window is at its midway position becomes 501 or 523.

In this manner, the user can reposition the window, and perform a fine adjustment with a degree of rotation of the dial.

The configuration of a wheel dial shown in FIG. 10 further includes the center protrusion 910 in addition to the wheel dial 410 as shown in FIG. 8. The center protrusion 910 of the wheel dial also assumes the center postion of the rotational range of the dial, and is protruded from the rest of the dial, and hence the user can recognize the center protrusion both visually and tactually.

In the similar manner to the jog dial shown in FIG. 9, the wheel dial according to this embodiment of the present invention returns to its original position after the user rotated the dial by a predetermined angle, and hence the center protrusion always maintains its direction Q1 toward the center.

Similarly, rotating the center protrusion to position Q2 moves the window from any current position to a 60% closed state, and then the center protrusion 910 returns to the position Q1. In the similar manner, a rotation to Q3 makes the window 80% closed, a rotation to Q5 makes the window 25% closed, a rotation to Q4 makes the window 100% closed, Q6 makes the window 100% opened, and after each dial rotation, the center protrusion 910 returns to the position Q1.

An apparatus for controlling a plurality of windows by using the above-mentioned jog dial or wheel dial is described below.

Figure 11:
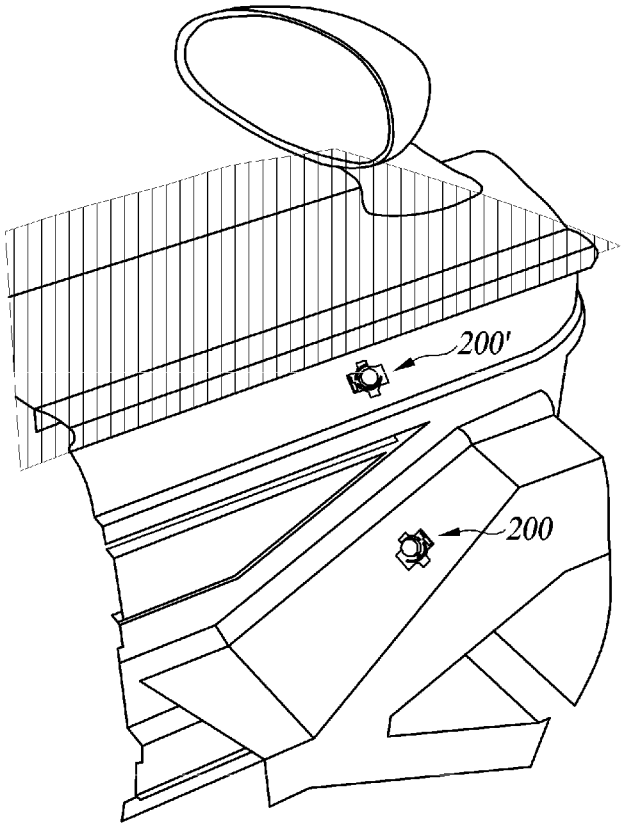
FIG. 11 is a perspective view of a part of a door with a jog dial arranged at a different location according to at least one embodiment of the present disclosure.

FIG. 11 is a perspective view of a part of a door with a jog dial arranged at optional locations according to at least one embodiment of the present disclosure.

In some embodiments of the present invention, as shown in FIG. 11, the jog dial 200 is installed at a position where a conventional window control resides or at a position closer to the window than that of the conventional window control. However, the positions of the jog dials 200, 200' shown in FIG. 11 are merely exemplary, and hence the jog dial can be installed wherever an operator can handle thereof.

Figure 12:
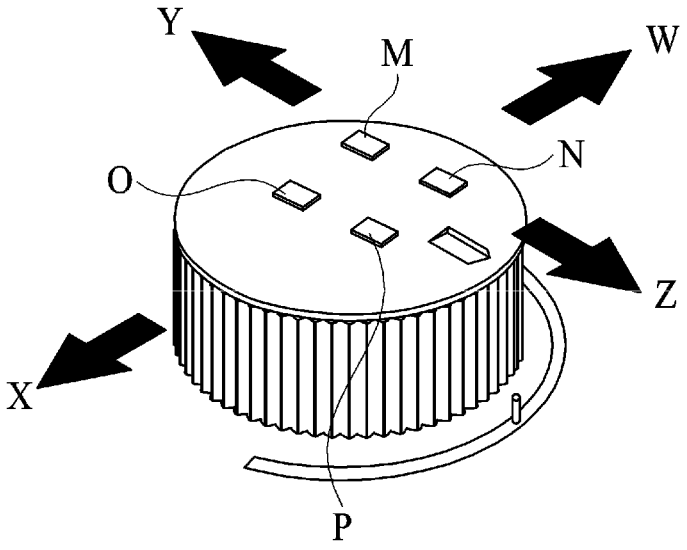
FIG. 12 is a perspective view of a jog dial having a function of controlling a plurality of windows according to at least one embodiment of the present disclosure.
Figure 13:
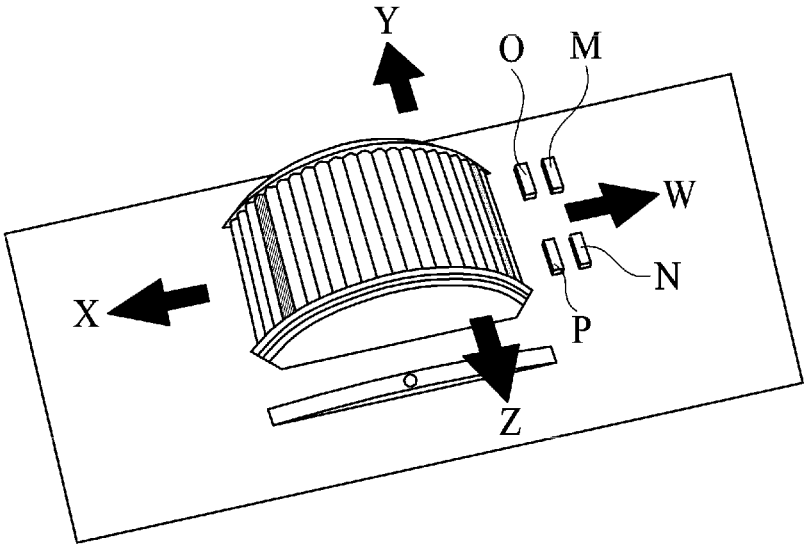
FIG. 13 is a perspective view of a wheel dial having a function of controlling a plurality of windows according to at least one embodiment of the present disclosure.

FIG. 12 is a perspective view of a jog dial having a function of controlling a plurality of windows according to at least one embodiment of the present disclosure. FIG. 13 is a perspective view of a wheel dial having a function of controlling a plurality of windows according to at least one embodiment of the present disclosure.

The following describes an input device for controlling each window at a vehicle driver seat by using the apparatus for opening/closing the window and for confirming the window position according to some embodiments of the present invention.

FIG. 12 is a perspective view of a jog dial having a function of controlling a plurality of windows according to at least one embodiment of the present disclosure. FIG. 13 is a perspective view of a wheel dial having a function of controlling a plurality of windows according to at least one embodiment of the present disclosure.

As shown in FIG. 12, a single jog dial can be used to control each or any of the vehicle side windows. In this case, a window to be controlled can be specified by pushing the jog dial in W, X, Y and Z directions, and the specified window can be controlled by using the jog dial.

The single jog dial 200 for this controllability has such a small footprint as to be installed even in a narrow space which secures more driver's space.

In some embodiments of the present invention, controlling the front side windows is performed by pushing the jog dial 200 in the direction W, and controlling the two right windows is performed by pushing the jog dial 200 in the direction Z. In the similar manner, the two left windows can be controlled by pushing the jog dial 200 in the direction Y, and the rear side windows can be controlled by pushing the jog dial 200 in the direction X.

When controlling a single window, the front right window can be controlled by pushing the jog dial 200 in the direction W and then in the direction Z, the rear right window can be controlled by pushing the jog dial 200 in the direction X and then in the direction Z, and the rear left window can be controlled by pushing the jog dial 200 in the direction X and then in the direction Y. In the similar manner, the front left window can be controlled by pushing the jog dial 200 in the direction W and then in the direction Y.

The driver's side window can be made easier to operate for its frequent use by the driver, and for a left-hand drive vehicle configuration, the front left window may be set to be exclusively controlled without initially pushing the jog dial in any direction. A right-hand drive vehicle may be configured in the similar manner that the front right window is set to be exclusively controlled unless the jog dial 200 is initially pushed in any direction.

Further, a centralized control of all the windows can be achieved by pushing the jog dial in the direction W two consecutive times to engage all windows, whereas the selection of all the windows is canceled by pushing the jog dial in the direction X two consecutive times or in the direction W three consecutive times, to reinstate the driver side window control.

The jog dial 200 further includes a controllable-window indicator. The controllable-window indicator is a device, including a lamp or a vibrator for indicating a specific window if it is controllable.

The controllability is notified to the user when the jog dial 200 is pushed to control one more windows as described above, by way of a particular local lamp turned on or a vibrator generating vibrations.

In the case of vibrator indication of the controllable window, an event of pushing the jog dial 200 to control two windows generates two short vibrations, and an event of pushing the jog dial 200 to control a single window generates one short vibration. Further, an event of pushing the jog dial 200 for a centralized control of all the windows generates one long vibration.

In the case of lamp indication, four lamps may be installed, such as a lamp M assigned to the left front window, a lamp N to the right front window, a lamp O to the left rear window, and a lamp P to the right rear window so that the respective windows controlled are highlighted by the corresponding lamps lit.

Therefore, when controlling two or more windows, the corresponding two or more lamps are turned on.

The user discerns the actual window or windows engaged by the indication of lamp lights or vibrations for subsequent control by the input of jog dial 200.

In a variation shown in FIG. 13, the wheel dial 800 as well, adopts the aforementioned scheme of pushing the wheel dial in W, X, Y and Z directions in specifying the window to be controlled with the lamp or vibrator arrangement adopted in the same manner as above for highlighting the controllable window.

A method is described below for opening/closing the window and confirming the window position according to some embodiments of the present invention.

Figure 14:
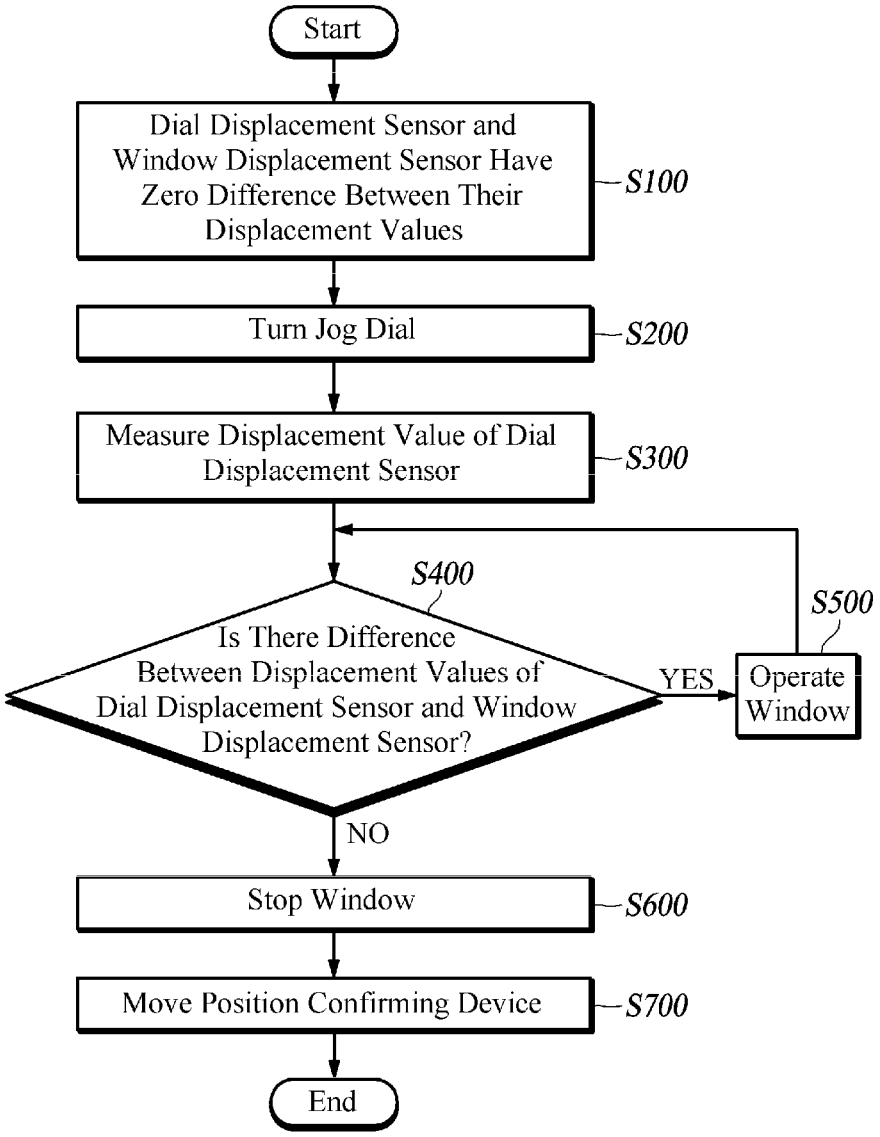
FIG. 14 is a flowchart of a method of controlling and confirming a window position by using a jog dial according to at least one embodiment of the present disclosure.

FIG. 14 is a flowchart of a method for controlling and confirming a window position by using a jog dial according to at least one embodiment of the present disclosure.

In the present embodiment of the method for controlling and confirming a window position, the initial condition has zero difference between the displacement values of the dial displacement sensor 110 and the window displacement sensor 120 (Step S100). This respresents a zero difference of displacement before the jog dial 200 is operated, where the displacement value of the dial displacement sensor 110 is the same as that of the window displacement sensor 120.

The user rotates the jog dial 200 (Step S200). The user rotates the jog dial 200 to open or close the window. The jog dial 200 can be rotated in the range between 0 degrees and 180 degrees. The user rotates the jog dial 200 by the amount corresponding to a desired position to move the window 140.

The changed displacement value of the dial displacement sensor is transferred to the control unit (Step S300). That is, as the displacement value of the dial displacement sensor 110 is changed with the rotation of the jog dial 200, the changed displacement value is transferred to the control unit 170.

In this case, the jog dial 200 has the rotatable range of 180 degrees, which is set proportionally equivalent to the whole movable range of the window 140 between the complete window closure where the position confirming device 160 is set to be at the 180-degree position and a full window opening where the position confirming device 160 is set to be at the 0-degree position.

The control unit 170 determines the difference between the displacement values of the dial displacement sensor 110 and the window displacement sensor 120 (Step S400). The control unit 170 utilizes potential difference values stored in the database as a basis for the determining of the difference between the displacement values of the dial displacement sensor 110 and the window displacement sensor 120. This is to figure out a moving range of the window 140 from the displacement value difference.

The window is operated (Step S500). In response to a difference between the displacement values of the dial displacement sensor 110 and the window displacement sensor 120, the window motor 130 is driven to operate the window 140. The window motor 130 is driven while changing the displacement value of the window displacement sensor 120 until there is no difference between the displacement values of the dial displacement sensor 110 and the window displacement sensor 120.

The window 140 is stopped (Step S600). When there is zero difference between the displacement value resulting from driving the window motor 130 and measured by the window displacement sensor 120 and the displacement value measured by the dial displacement sensor 110, the window motor 130 and thus the window is stopped.

With the above-mentioned steps, the user does not need to keep on pressing the input switch button until the window 140 moves to a desired position, which provides the user with the operating convenience of the window.

The position confirming device 160 moves in Step S700. Following an instruction from the control unit 170, the protrusion 220 of the position confirming device 160 moves by the proportion the window actually moved to its full range of operation. The position confirming device 160 is driven by a servo motor 440, and the protrusion 220 of the position confirming device 160 moves semicircularly or linearly in parallel with the input dial 100.

The position confirming device 160 can move after or concurrently with the movement of the window 140.

Therefore, the user can figure out the degree of opening the window 140 requiring no visual aid but just the sense of touching the protrusion 220 of the position confirming device 160, keeping the driver's view unobstructed to secure a safety driving.

Figure 15:
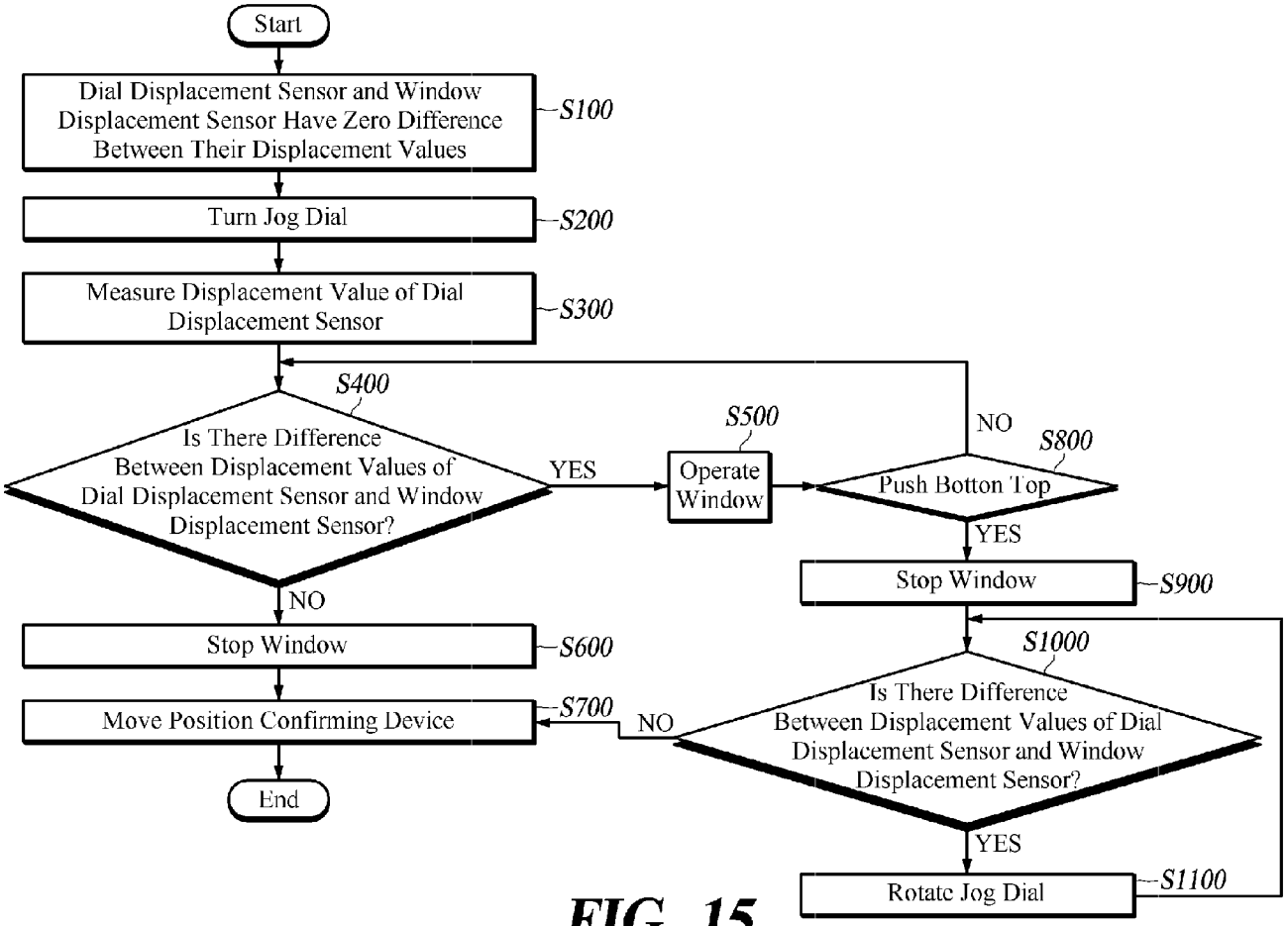
FIG. 15 is a flowchart of a method of controlling and confirming a window position by using a jog dial with further pressing a button top according to at least one embodiment of the present disclosure.

FIG. 15 is a flowchart of a method of controlling and confirming a window position by using a jog dial with further pressing a button top according to at least one embodiment of the present disclosure.

The method of opening/closing the window and confirming the window position with further pressing the button top according to some embodiments of the present invention includes pressing the button top 420 while the window motor is being driven (Step S800). When the window 140 is caused to move more than desired, the user can press the button top 420 to stop the window motor 130 immediately without needing to wait until the window 140 completes its operation before restarting to rotate the jog dial 200.

The window is stopped in Step S900. The user can press the button top 420 of the jog dial 200 to override further operation of the window motor 130 in response to the difference between the displacement values of the dial displacement sensor 110 and the window displacement sensor 120, which stops the window motor 130 and thus the window.

Thereafter, the control unit 170 determines whether or not there is a difference between the displacement values of the dial displacement sensor 110 and the window displacement sensor 120 (Step S1000). This step is needed to determine if the displacement value difference is "0" because the window motor 130 was stopped while the displacement value of the window displacement sensor 120 is changed.

A rotation of the jog dial 200 is performed in Step S1100. When the difference between the displacement values of the dial displacement sensor 110 and the window displacement sensor 120 is not "0", it needs to be zeroed.

The stopped window motor 130 fixes the displacement value of the window displacement sensor 120, and therefore the jog dial 200 is rotated to change the displacement value of the dial displacement sensor 110 until the displacement value difference becomes zero. In this case, the jog dial 200 is rotated by driving the servo motor 440.

The position confirming device 160 is moved in Step S700. When the difference between the displacement values of the dial displacement sensor 110 and the window displacement sensor 120 becomes "0", the protrusion 220 of the position confirming device 160 moves by the ratio of the actual movement in the whole movable range of the window by an instruction from the control unit 170.

The position confirming device 160 is driven by the servo motor 440, through which the user can figure out the moved position of the window 140.

Figure 16:
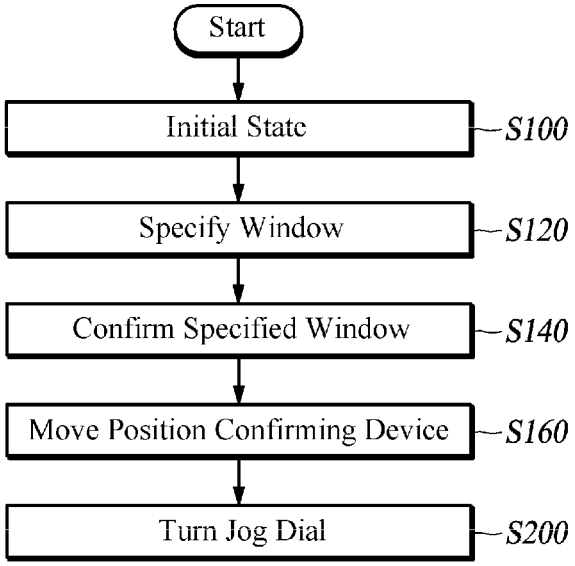
FIG. 16 is a flowchart of a method of controlling and confirming a window position with an additional step of specifying a window with the jog dial according to at least one embodiment of the present disclosure.

FIG. 16 is a flowchart of a method of controlling and confirming a window position with an additional step of specifying a window with the jog dial according to at least one embodiment of the present disclosure.

The method of opening/closing the window and confirming the window position with an additional designation of a window by the jog dial 200 may include specifying a specific window (Step S120). A window to be moved is determined by pushing the jog dial 200 rather than rotating the dial 410 of the jog dial 200.

The window 140 can be determined in the same way as in the embodiments described above.

Thereafter, in some embodiments, the method includes confirming the specified window (Step S140). This can be confirmed by using lamps and a vibrating unit. When the user slides the jog dial 200 to determine a window to be controlled, the vibrating unit provides a vibration or a lamp oriented to the specified window is turned on to inform the user of the specific window ready to be controlled.

In some embodiments, the method further includes moving the position confirming device 160 (Step S160). With every window having different opening/closing status, the user can be informed in this step of the state of the window specified to control.

The position confirming device moves by the opening amount of the specified window to inform the user of the current window position of the specified window.

Figure 17:
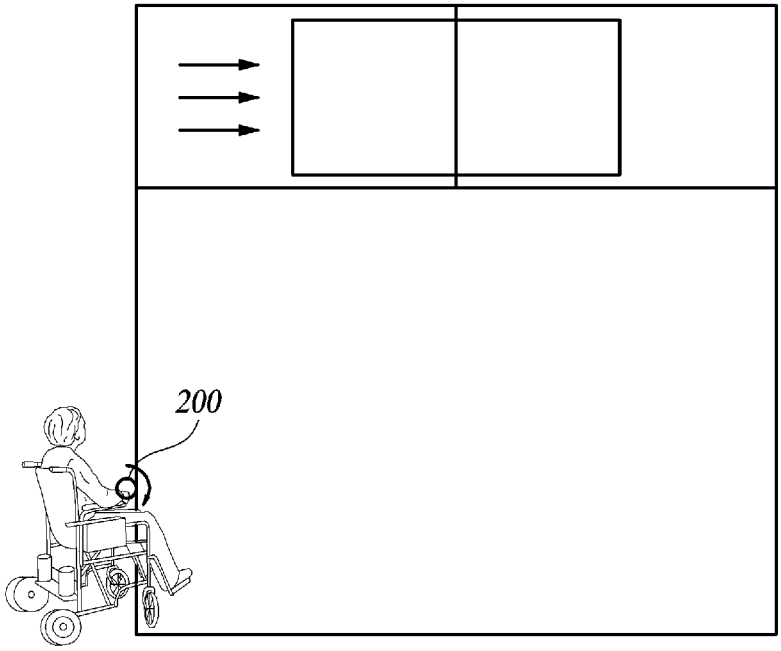
FIG. 17 is a schematic diagram for illustrating a different field of application of the apparatus for controlling and confirming a window position according to at least one embodiment of the present disclosure.

FIG. 17 is a schematic diagram for illustrating an application of the apparatus for controlling and confirming a window position according to at least one embodiment of the present disclosure in a different field.

As shown in FIG. 17, the apparatus for opening/closing and confirming a window according to some embodiments of the present invention can be used for, as well as the window of a vehicle, a window used in residence where windows are used or for a sunroof of a vehicle. Opening and closing a window that is difficult to reach or handle can be conveniently assisted by the jog dial with the confirmation of the current window position.

Although exemplary embodiments of the present disclosure have been described for illustrative purposes, those skilled in the art will appreciate that various modifications, additions and substitutions are possible, without departing from the idea and scope of the claimed invention. It should be understood that the scope of the invention is interpreted by the claims, and that all technical ideas identical or equal to the claims and equivalents thereof are within the scope of the present invention.

CROSS-REFERENCE TO RELATED APPLICATION

This application claims priority under 35 U.S.C § 119(a) of Patent Application No. 10-2015-0092554, filed on Jun. 29, 2015 in Korea, the entire content of which is incorporated herein by reference. In addition, this non-provisional application claims priority in countries, other than the U.S., with the same reason based on the Korean patent application, the entire content of which is hereby incorporated by reference.

The invention claimed is:

1. An apparatus for controlling and confirming a window position of a car, the apparatus comprising:

an input dial including a jog dial or a wheel dial and configured to generate an input signal in response to a dialing operation by a user;

a dial displacement sensor configured to generate a displacement value changing with a rotation of the input dial;

a window motor configured to adjust a degree of opening and closing of the window according to the displacement value of the dial displacement sensor;

a window displacement sensor configured to generate a displacement value changing with a rotation of the window motor;

a position confirming device configured to inform the user of a current window position based on the displacement value of the window displacement sensor in a tactile manner, wherein a position of the window is determined by a magnitude of the input signal generated by the input dial, and the jog dial or the wheel dial is configured to rotate according to a range of movement of the window at a one to one ratio.

2. The apparatus of claim 1, further comprising a control unit configured to control opening and closing of the window upon receiving the signal generated by the input dial, and control the position confirming device depending on the current window position.

3. The apparatus of claim 2, wherein the jog dial or the wheel dial is configured to rotate in a range of 180 degrees.

4. The apparatus of claim 2, wherein the jog dial comprises a dial configured to rotate about an axis of the dial and to change an input quantity in association with a rotation amount thereof, and a button top arranged on the dial and configured to be depressed to function.

5. The apparatus of claim 4, wherein the button top is configured to be depressed for interrupting the window motor in operation.

6. The apparatus of claim 4, wherein the jog dial includes a center protrusion formed on one side of the dial, the center protrusion assuming a center position of a rotatable range of the dial, and being responsive to a user's rotating operation of the dial for reassuming the center position by rotating the dial.

7. The apparatus of claim 4, further comprising a lamp on the button top, wherein the lamp is configured to be turned on when operating the dial or when operating the window.

8. The apparatus of claim 2, wherein the wheel dial comprises a dial configured to rotate about an axis of the dial and to change an input quantity in association with a rotation amount, and the dial is configured to have a top portion to be depressed for taking a further input.

9. The apparatus of claim 8, wherein the top portion of the wheel dial is configured to be depressed for interrupting the window motor in operation.

10. The apparatus of claim 8, wherein the wheel dial includes a center protrusion formed on one side of the dial, the center protrusion assuming a center position of a rotatable range of the dial, and being responsive to a user's rotating operation of the dial for reassuming the center position by rotating the dial.

11. The apparatus of claim 8, wherein the wheel dial is configured to take an input by sliding the wheel dial to specify a window of the car to be controlled by sliding the wheel dial.

12. The apparatus of claim 11, wherein the wheel dial is provided with frontwardly disposed lamps corresponding to a plurality of windows of the car, and when a window of the car to be controlled is specified by sliding the wheel dial, a lamp corresponding to the specified window is turned on.

13. The apparatus of claim 11, further comprising a vibrating unit configured to vibrate the wheel dial, wherein when a window of the car to be controlled is specified by sliding the jog dial, the vibrating unit is configured to vibrate the jog dial.

14. The apparatus of claim 2, wherein the dial displacement sensor and the window displacement sensor each comprises a potentiometer configured to measure a variable resistance value.

15. The apparatus of claim 14, wherein the control unit is configured to drive the window motor based on a difference between a variable resistance value of the dial displacement sensor and a variable resistance value of the window displacement sensor.

16. The apparatus of claim 2, wherein the dial displacement sensor and the window displacement sensor each comprises a rotary encoder configured to measure a difference in incrementing or decrementing encoder outputs between the dial displacement sensor and the window displacement sensor.

17. The apparatus of claim 2, further comprising a servo motor configured to rotate the position confirming device or the input dial.

18. The apparatus of claim 2, wherein the position confirming device is driven by a mechanical mechanism.

19. The apparatus of claim 1, wherein the position confirming device includes a protrusion configured to move semicircularly in parallel with the jog dial or linearly in parallel with the wheel dial.

20. The apparatus of claim 1, wherein the jog dial is configured to take an input by sliding the jog dial and to specify a window to be controlled by sliding the jog dial.

21. The apparatus of claim 20, wherein the jog dial includes lamps corresponding to a plurality of windows of the car on the button top, and when a window of the car to be controlled is specified by sliding the jog dial, a lamp corresponding to the specified window is turned on.

22. The apparatus of claim 20, further comprising a vibrating unit configured to vibrate the jog dial, wherein when a window of the car to be controlled is specified by sliding the jog dial, the vibrating unit is configured to vibrate the jog dial.

* * * * *